United States Patent [19]

Tange

[11] 4,169,346

[45] Oct. 2, 1979

[54] BINDING DEVICE FOR BINDING OPENINGS OF BAGS OR THE LIKE

[75] Inventor: Fumiko Tange, Nagoya, Japan

[73] Assignee: Kaoru Ogasawara, Kyoto, Japan; a part interest

[21] Appl. No.: 896,677

[22] Filed: Apr. 14, 1978

[30] Foreign Application Priority Data

Feb. 14, 1978 [JP] Japan ..... 53-15727

[51] Int. Cl.[2] ..... B65B 57/08

[52] U.S. Cl. ..... 53/583; 140/93 A

[58] Field of Search ..... 53/138 A, 370, 583; 100/3, 10; 140/93 A, 93.6

[56] References Cited

U.S. PATENT DOCUMENTS

| | | | |
|---|---|---|---|
| 3,039,249 | 6/1962 | Bouchard | 53/583 N |
| 4,043,363 | 8/1977 | Tange | 140/93 A |
| 4,054,160 | 10/1977 | Knudsen | 53/138 A |
| 4,087,951 | 5/1978 | Tsuda et al. | 53/583 |

*Primary Examiner*—John Sipos

*Attorney, Agent, or Firm*—Wenderoth, Lind & Ponack

[57] ABSTRACT

A binding device for binding the openings of bags or the like which is small and simple in structure but effective in operation without requiring an electric power source. The binding device comprises: a stationary vertical support plate carrying a reel of binding material, a pair of rocking plates pivotally secured to the support plate, a cord delivery mechanism having a pair of supporting rollers, a cord winding mechanism having an actuating rod, an actuating plate and a pair of winding arms, a cord cutting mechanism, and a cord twisting mechanism having an engaging pawl to twist the end portions of a cut cord piece together.

5 Claims, 7 Drawing Figures

BINDING DEVICE FOR BINDING OPENINGS OF BAGS OR THE LIKE

BACKGROUND OF THE INVENTION (1) Field of the Invention

This invention relates to a binding device for binding the openings of bags or other materials. More particularly, the invention relates to a binding device for binding the openings of bags made of plastic films, regenerated cellulose films, netting or the like and other long articles by applying binding materials to them like ribbons and automatically twisting the binding materials.

(2) Description of the Prior Art

A large variety of bags are widely used for putting various things such as bread, green vegetables, and other granular or lumpy materials into them. When the opening of a bag containing some material is closed up, a ribbon-like wire-carrying cord is wound around the bag opening and the end portions of the cord are then twisted together.

In recent years, there have been proposed different types of apparatus to perform this twisting work mechanically. However, they are generally complicated in structure and operation, and in addition, malfunctioning and other troubles are liable to occur. Further, since the twisting force is relatively weak, the binding may be somewhat loose and the twisted binding material can be easily moved on the bag opening portion. Because of such defects, satisfactory results have not been obtained.

In the apparatus as disclosed in Japanese Patent Publication No. Sho. 41-6077 (1966) (corres. to U.s. Pat. application Ser. No. 341,954now abandoned), the tying work is done by converting continuous rotary motion into intermittent rotary motion by using a rotary disk and a program plate that are interlocked to an electric motor. However, the apparatus itself is large-scale and complicated, and since it is electrically powered, the places where it can be used are restricted and it cannot be easily transferred as desired.

The apparatus disclosed in Japanese Patent Publication No. Sho. 49-16759 (1974) (corres. to British Pat. No. 1,115,734) is also an electrically powered one and the tying work is done with a rocking crank that is interlocked to an endless chain, so that this apparatus is not be free from the disadvantages described above. Further, in the apparatus disclosed in U.S. Pat. No. 3,825,039, the feeding of binding cord, cutting of the cord and the tying of the cord around the opening of a bag are performed by the drive of an air cylinder, so that it is not free from the defects of the above described devices.

While, as described in U.S. Pat. No. 3,538,960 (corres. to British Pat. No. 1,264,993), a small portable binding device has been proposed, however, in this device, the feeding and cutting of a cord is done by a link mechanism and the twisting shaft is rotated by a tension cord which is attached to one end portion of the same link mechanism. With such a structure, malfunctioning and other problems are easily caused to occur so that the device cannot be satisfactorily placed in practical service.

BRIEF SUMMARY OF THE INVENTION

The primary object of the present invention is to provide an improved binding device for binding the openings of bags or the like, which is free from the above described disadvantages.

Another object of the present invention is to provide a binding device which is portable and simple in structure, and can be used in a small workshop and the like without difficulty.

A further object of the present invention is to provide a binding device which is free from the malfunctioning and other troubles.

A still further object of the present invention is to provide a binding device in which the feeding, cutting and twisting of the binding material relative to the article to be bound is performed in a series of interlocked mechanisms.

In accordance with the present invention, the binding device for bundling the opening of a bag or the like comprises stationary vertical support plate which carries thereon a reel of binding material such as iron wire, wire-carrying cord or stiff cord; a pair of rocking plates which are pivotally secured to the support plate; a cord delivery mechanism which comprises a pair of cord supporting rollers; a cord winding mechanism which is disposed above the cord delivery mechanism and comprises an actuating rod, an actuating plate and a pair of L-shaped winding arms; a cord cuttng mechanism which is disposed in front of the cord delivery mechanism and provided wth a cutting blade; and a cord twisting mechanism which is provided with an engaging pawl and disposed below the U-shaped recesses for receiving the opening of a bag, which recesses are formed in the front portion of the above rocking plates.

BRIEF DESCRIPTION OF THE DRAWINGS

Other objects and features of the invention will become apparent from the following description taken with the accompanying drawings, in which.

DETAILED DESCRIPTION OF THE PREFERRED EMBODIMENT

Referring now to the accompanying drawings, the embodiment of the binding device for binding the openings of bags or the like will be described in detail as a preferred example and by no means a restrictive one.

Figure 1:
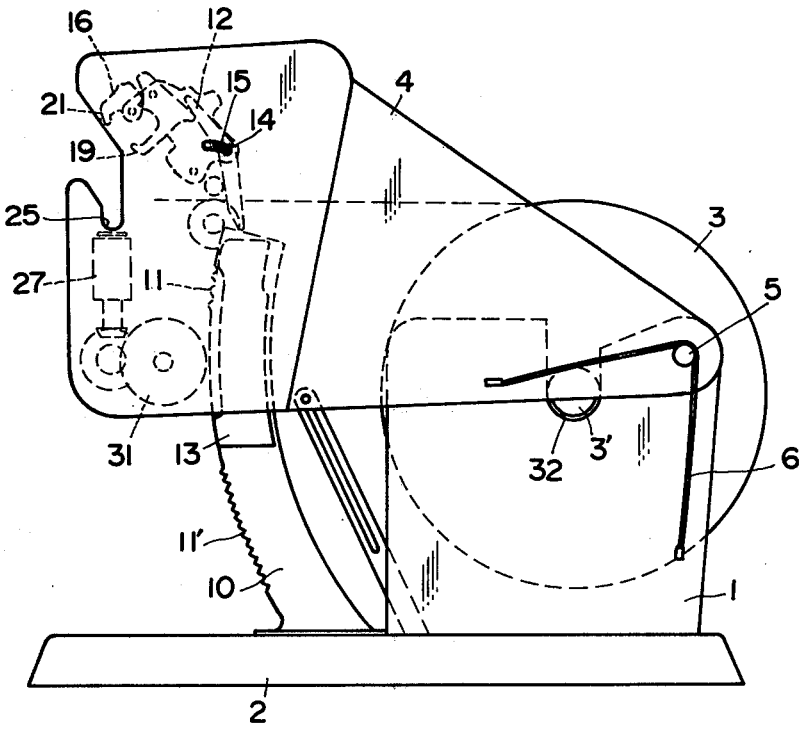
FIG. 1 is a side view of an embodiment of the invention.
Figure 2:
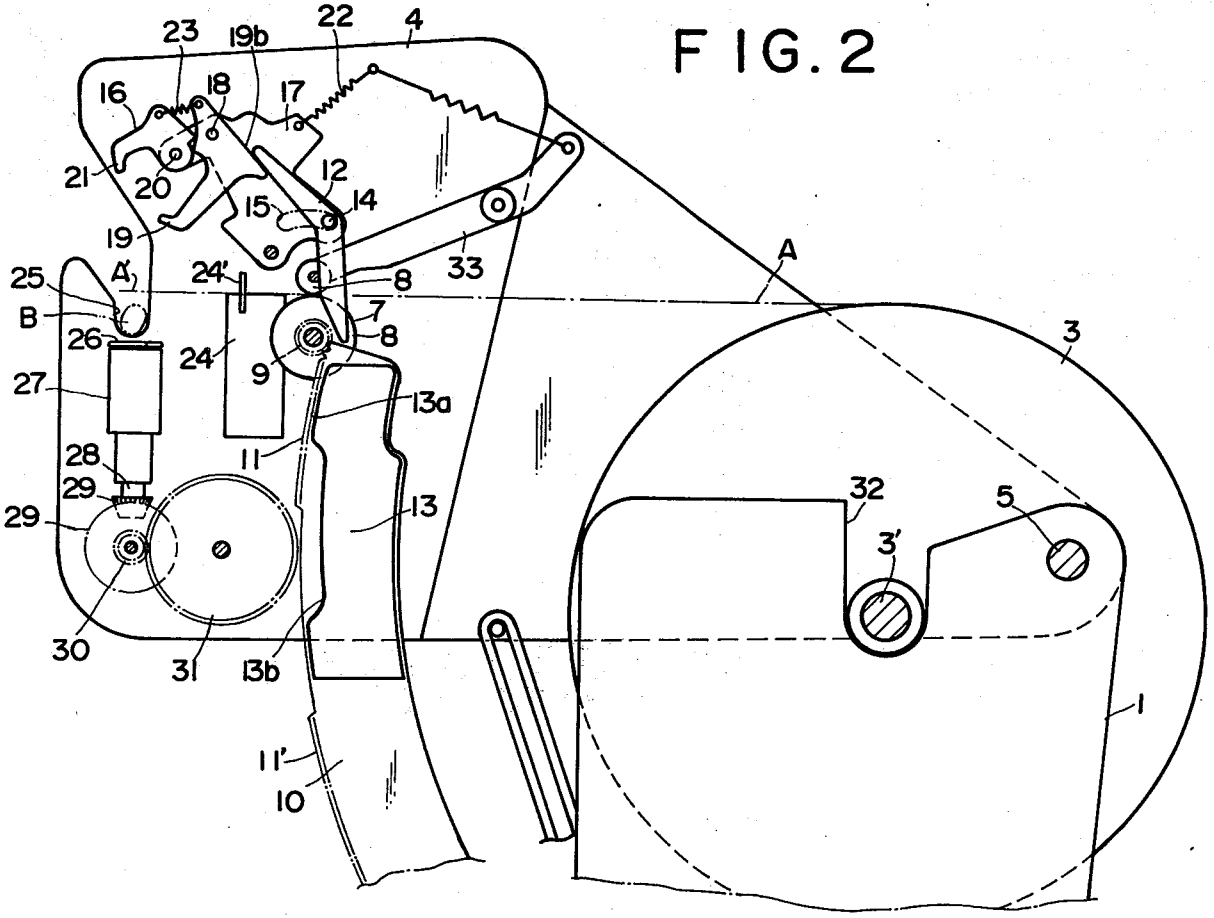
FIG. 2 is an enlarged side view of the main portion of the same embodiment.
Figure 3:
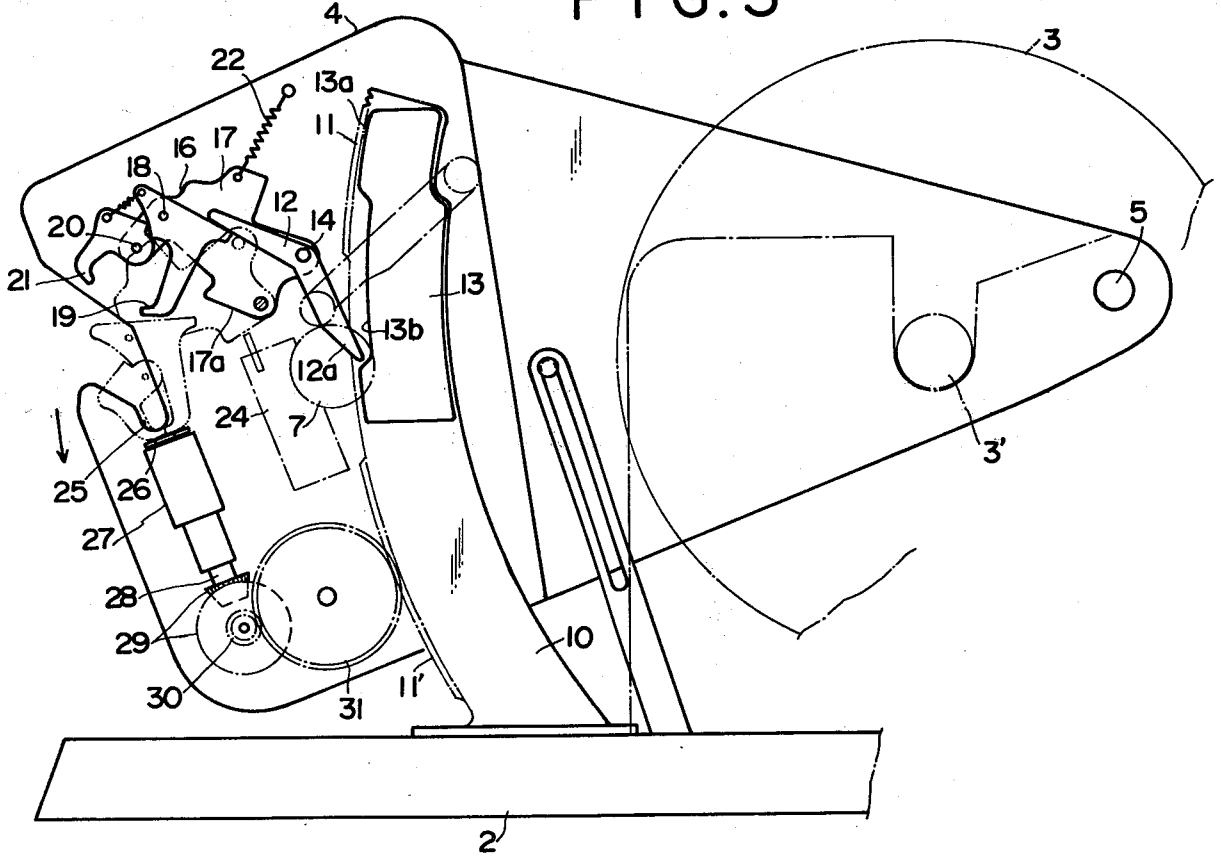
FIG. 3 is also an enlarged side view of the same in the depressed position.
Figure 6:
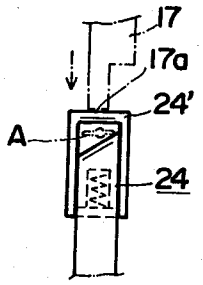
FIG. 6 is a front view of a cord cutting mechanism.
Figure 7:
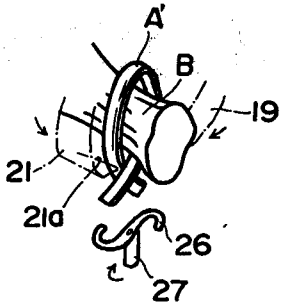
FIG. 7 is a schematic illustration showing the twisting of a binding cord applied around the opening of a bag.
Figure 5:
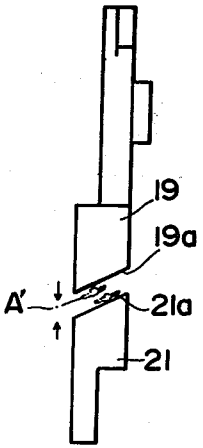
FIG. 5 is a bottom view of winding arms.
Figure 4:
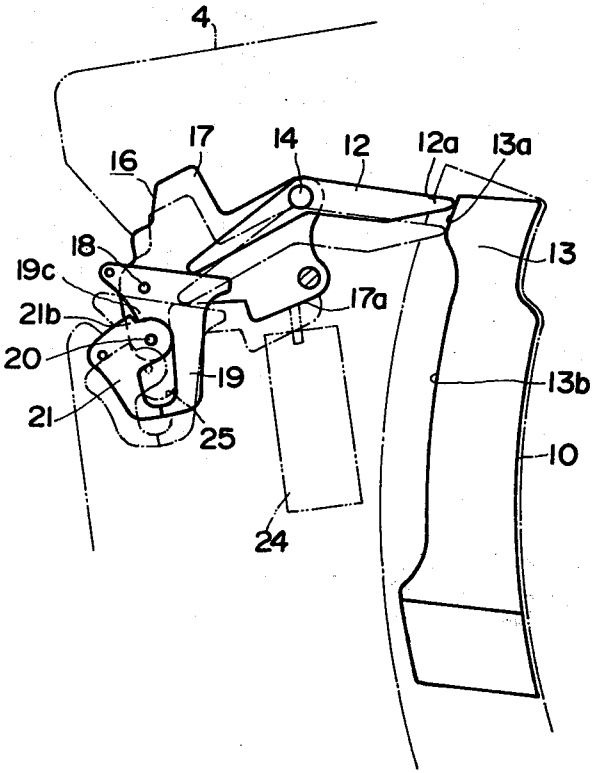
FIG. 4 is a schematic illustration showing the main part of a cord winding mechanism.

A vertical support plate 1 is set mounted upright at right angles to a horizontal bed plate 2. In the upper rear part of the vertical support plate 1 is formed a reel supporting groove 32 which supports the shaft 3' of a reel 3. The reel 3 carries thereon a binding material such as iron wire, wire-carrying cord or stiff cord. There are provided a pair of triangular rocking plates 4 for depressing the mechanisms. A pivot shaft 5 is attached to the apexes of the rocking plates 4 and it is pivotally secured on both sides of the rear corner of the vertical support plate 1. A spring 6 is fitted on the pivot shaft 5 and engages plates 4, for urging the rocking plates 4, so that the lower edges of the rocking plates 4 are generally held in parallel to the bed plate 2. The reference numeral 7 denotes a cord delivery mechanism which comprises a pair of supporting rollers 8*a* and 8*b* that are mounted on the middle portion of the front sides of the rocking plates 4. In this cord delivery mechanism 7, the gear 9 formed on the lower supporting roller 8*b* is brought into engagement with an upper rack 11 which is formed on a stationary arcuate guide plate 10 that is attached to the bed plate 2. This arcuate guide plate 10 is disposed along a circular arc about the pivot shaft 5 of the rocking plates 4. The upper supporting roller 8*a* is carried by a tension arm 33. A bent actuating rod 12 is disposed above the cord delivery mechanism 7 and pivoted on a shaft 14 mounted on a plate 17. When the rocking plates 4 are pivoted downward, the lowermost end 12*a* of the actuating rod 12 is brought into contact with a cam shoulder 13 which is formed on the front edge of the arcuate guide plate 10, thus turning the actuating rod 12 about the pivot shaft 14 thereof. In this operation, the pivot shaft 14 is moved a little along guiding slots 15 which are formed in the rocking plates 4. Disposed above the cord delivery mechanism 7 is a cord winding mechanism 16 which comprises an actuating plate 17 an end portion of which is pivotally secured to the plates 4 by shaft 176, a L-shaped winding arm 19 which is attached to the upper front portion of the actuating plate 17 by a pivot shaft 18, and another winding arm 21 which is attached to the lower front portion of the same plate 17 by a shaft 20. The supporting faces 19*a* and 21*a* at the free ends of the winding arms 19 and 21 are oblique to the axis between them, as shown in FIG. 5, so as to cause the supported cord to slide laterally. Further, the free end of the actuating arm 12 is brought into contact with a shoulder 19*b* on the winding arm 19. The reference numeral 22 denotes a return spring which is attached to an end portion of the actuating arm 17. The reference numeral 23 denotes another return spring which is stretched between the winding arms 19 and 21. A cord cutting mechanism 24 is disposed in front of the delivery mechanism 7. When the actuating plate 17 is turned, the pushing face 17*a* of the plate 17 is pressed against the upper edge of an inverted U-shaped blade 24' of the cutting mechanism 24, so that the cord A delivered from the delivery mechanism 7 is cut by the depression of the blade 24'. In the front sides of the rocking plates 4, U-shaped recesses are formed for receiving therein an article to be bound, and the pair of winding arms 19 and 21 are moved downward toward the U-shaped recesses 25. Under the U-shaped recesses 25 is disposed a cord twisting mechanism 27 which is provided with an S-shaped engaging pawl 26. The lower end of the drive shaft 28 for the mechanisms 27 is provided with bevel gears 29. The shaft of one of the above bevel gears 29 has a gear 30 thereon which meshes with a driving gear 31. When the rocking plates 4 are pivoted down, this driving gear 31 is brought into engagement with the lower rack 11' that is formed on the lower part of the arcuate guide plate 10.

The operation of the above-described device will be explained in the following.

A binding cord A such as wire-carrying vinyl cord is wound on the reel 3 and this reel 3 is mounted in reel supporting groove 32 of the vertical support plate 1. The free end of the cord A is pulled out and it is fitted between the supporting rollers 8*a* and 8*b* of the cord delivery mechanism 7.

Then, the opening B of a bag to be bound is placed into the U-shaped recesses 25 and the bag opening B is further pushed down. By this operation, the rocking plates 4 are turned about the pivot shaft 5. The upper rack 11 of the arcuate guide plate 10 is firstly engaged by the gear 9 of the delivery mechanism 7 and the gear 9 is rotated. Thus the binding cord A is advanced by means of the pair of supporting rollers 8*a* and 8*b*. At the same time, since the lowermost end 12*a* of the actuating rod 12 rides on the cam surface 13*a* of the shoulder 13 that is formed on the side face of the guide plate 10, the actuating rod 12 is turned about the pivot shaft 14. With this action, the other end of actuating rod 12 pushes the shoulder 19*b* of the winding arm 19, so that the winding arm 19 is turned clockwise about the pivot shaft 18. As a result, the supporting face 19*a* of the arm 19 is moved toward the opposed winding arm 21. The cam pawl 19*c* of the winding arm 19 pushes up the engaging shoulder 21*b* of the other winding arm 21, so that the winding arm 21 is also turned counterclockwise about the pivot shaft 20 and the supporting face 21*a* at the free end there of is moved toward the supporting face 19*a* of the above-mentioned winding arm 19. During this operation, the shaft 14 moves in slot 15 due to the cooperation between the rod 12 and cam 13 to pivot plate 17 counterclockwise, and since the winding arms 19 and 21 are turned together with the actuating plate 17, they are moved toward the bag opening B held in the U-shaped recesses 25 and both the end portions of the cord piece A' applied on the bag opening B are pushed down. It will be understood that, when the winding arms 19 and 21 are moved toward the U-shaped recesses 25, the delivered bundling cord A is cut into a cord piece A' of a certain length because the pushing face 17*a* of the actuating plate 17 depresses the blade 24' in the cord cutting mechanism 24.

Since the supporting faces 19*a* and 21*a* are inclined, the end portions of the cord piece A' that are bent down around the bag opening B by the winding arms 19 and 21, are finally twisted crosswise to right and left to an initial twisted state.

After that, when the rocking plates 4 are further moved down, the driving gear 31 of the twisting mechanism 27 is brought into engagement with the lower rack 11' of the arcuate guide plate 10. By power transmitted from the driving gear 31, the free ends of the cord piece A' are caught by the engaging pawl 26 and they are twisted together around the bag opening B, thereby completing the binding of the bag opening B.

During the twisting of the cord piece A', the lowermost end 12*a* of the actuating rod 12 that has been moved along the cam shoulder 13*a* of the guide plate 10, falls into the recess 13*b* from the cam surface 13*a*. Therefore, the restriction to the actuating rod 12 by the cam surface 13*a* is released and the actuating rod 12 together with the actuating plate 17 is raised by the returning force of the spring 22, thereby releasing the pushing action on the winding arm 19. At the same time as this operation, the opposed winding arm 21 is also released and, being spring connected to the arm 19, is pivoted away from arm 19.

When the twisting of the cord piece A' around the bag opening B is completed, the rocking plates 4 are positioned at the lowermost level of pivoting movement around the pivot shaft 5. Accordingly, when the bag opening B is to be bound, it is necessary only that the bag opening B be put into the U-shaped recesses 25 formed in the front portions of the rocking plates 4 and the rocking plates 4 pressed down to the lowermost position.

In the present invention as described above, the rocking plates having U-shaped recesses and are pivotally secured to the vertical support plate that carries the reel of a binding material. The cord delivery mechanism, cutting mechanism and winding mechanism are mounted on the rocking plates and the arcuate guide plate is provided in the space between the rocking plates on the lower part of the device. The above delivery, cutting and winding mechanisms are interlocked by means of the upper rack and the side cam shoulder formed on the arcuate guide plate. The cord twisting mechanism that is disposed under the U-shaped recesses is interlocked with the lower rack of the above guide plate. Therefore, when the bag opening to be bound is put into the U-shaped recesses and is pushed down, the binding operation is completed at the lowermost position to which the bag is pushed. Accordingly, the binding operation is quite easy and simple (one movement operation). In addition, since the structure of the device of the present invention mainly comprises the transmission mechanisms of cams and gears, there is no need for an electric power source. Further, the device of the present invention can be used for a long time without trouble and damage. Still further, the device of the present invention can be made in a compact form.

In addition to the above advantages, since the supporting faces of both the winding arms are inclined, the cord piece of a certain length can be applied to the bag opening in a crosswise manner by lowering the winding arms. Accordingly, even though the engaging pawl of the twisting mechanism has a simple S-shape, the end portions of the cord can be caught by the engaging pawls without fail. From this viewpoint, there is no fear of malfunction of the binding device.

Although the present invention has been described in connection with a preferred embodiment thereof, many variations and modfications will become apparent to those skilled in the art. It is preferred, therefore, that the present invention be limited not by the specific disclosure herein, but only by the appended claims.

What is claimed is:

1. A binding device for binding the openings of bags or the like which comprises a stationary vertical support plate which carries thereon a reel for a binding material such as iron wire, wire-carrying cord or stiff cord; a pair of rocking plates which are pivotally secured at their end portions to said support plate; a cord delivery mechansim which comprises a pair of supporting rollers mounted on said rocking plates that are rotated by an upper rack formed on the front side of a stationary arcuate guide plate which is disposed in front of said vertical support plate; a cord winding mechanism mounted on said rocking plates which is disposed above said cord delivery mechanism and comprises a pivotable actuating plate and a pair of L-shaped winding arms mounted on said plate, an actuating rod mounted on said plate and operated by a cam shoulder formed on the side face of said arcuate guide plate to pivot said plate and arms; a cord cutting mechanism which is disposed in front of said cord delivery mechanism and is operated by the pivoting of said actuating plate; and a cord twisting mechanism mounted on said rocking plate which is disposed below U-shaped recesses for receiving said bag opening, which recesses are formed in the front portions of said rocking plates, said twisting mechanism being provided with an engaging pawl which is rotated by a rack formed on the lower part of said arcuate guide plate; whereby when said rocking plates are pivoted down by pushing an article to be bound into said U-shaped recesses, a length of said binding material is delivered from said cord delivery mechanism, said binding material is then cut by said cord cutting mechanism to form a piece of cord, said piece of cord is applied to and bent around the article to be bound by means of said cord winding mechanism, and both the end portions of said cord piece are caught and twisted together by said cord twisting mechanism.

2. The binding device as claimed in claim 1, wherein said actuating plate of said cord winding mechanism is guided by arcuate guide slots formed in said rocking plates so as to move arcuately during its pivoting motion.

3. The binding device as claimed in claim 1 or 2, wherein the supporting faces at the free ends of said pair of L-shaped winding arms of said winding mechanism are oblique relative to the axis between them and parallel to each other.

4. The binding device as claimed in claim 1, wherein one of said pair of supporting rollers is mounted on a tension arm.

5. The binding device as claimed in claim 1, wherein the blade of said cord cutting mechanism has an inverted U-shape and is directly contacted by said actuating plate of said cord winding mechanism which is disposed directly above it.

* * * * *